US012390679B2

(12) United States Patent
Jenkins

(10) Patent No.: US 12,390,679 B2
(45) Date of Patent: Aug. 19, 2025

(54) EXERCISE BELT

(71) Applicant: Keya Jenkins, Bountiful, UT (US)

(72) Inventor: Keya Jenkins, Bountiful, UT (US)

(73) Assignee: Keya Jenkins, Bountiful, UT (US)

( * ) Notice: Subject to any disclaimer, the term of this patent is extended or adjusted under 35 U.S.C. 154(b) by 172 days.

(21) Appl. No.: 18/488,019

(22) Filed: Oct. 16, 2023

(65) Prior Publication Data

US 2024/0123278 A1 Apr. 18, 2024

Related U.S. Application Data

(60) Provisional application No. 63/416,480, filed on Oct. 14, 2022.

(51) Int. Cl.

| | |
|---|---|
| ***A63B 21/00*** | (2006.01) |
| ***A63B 21/04*** | (2006.01) |
| ***A63B 23/00*** | (2006.01) |

(52) U.S. Cl.

CPC ..... *A63B 21/4009* (2015.10); *A63B 21/0442* (2013.01); *A63B 23/00* (2013.01); *A63B 2209/10* (2013.01); *A63B 2225/09* (2013.01)

(58) Field of Classification Search

CPC . A63B 21/0442; A63B 21/065; A63B 21/068; A63B 21/4009; A63B 21/4039; A63B 23/00; A63B 23/02; A63B 2209/10; A63B 2225/09

See application file for complete search history.

(56) References Cited

U.S. PATENT DOCUMENTS 1,372,026 A * 3/1921 William ..... A63B 23/03533 482/123
4,492,373 A * 1/1985 Dzitzer ..... A63B 7/00 482/143
5,158,510 A * 10/1992 Lemire ..... A63B 21/4001 52/74
5,209,712 A * 5/1993 Ferri ..... A61H 1/02 482/131
5,238,279 A * 8/1993 Anteau ..... B66C 1/18 294/74
5,336,151 A * 8/1994 Van Ballegooie ..... A63B 21/0442 482/121
5,360,384 A * 11/1994 Toensing ..... A63B 21/4009 482/43

(Continued)

FOREIGN PATENT DOCUMENTS

KR 20220042855 A * 4/2022

*Primary Examiner* — Gary D Urbiel Goldner

(57) ABSTRACT

An exercise belt includes an elongated belt, a padded portion, a strap, and first and second rings. The padded portion has a length less than a length of the elongated belt. The elongated belt is stitched with the padded portion at a point other than at first and second opposing ends of the elongated belt. The first and second rings are identical and are coupled to the first and second opposing ends of the elongated belt. The strap is disposed between the elongated belt and the padded portion which may provide additional structural support. The length of the elongated belt may be shortened by respectively routing the first and second opposing ends through first and second slits in the elongated belt and then respectively coupling the first and second opposing ends to corresponding hook and loop fasteners adjacent to each of the first and second opposing ends.

18 Claims, 5 Drawing Sheets

(56) References Cited

U.S. PATENT DOCUMENTS

| | | | | |
|---|---|---|---|---|
| 5,769,764 | A * | 6/1998 | Tilberis | A63B 23/03575 482/126 |
| 5,919,119 | A * | 7/1999 | Bohmer | A63B 22/02 482/69 |
| 8,858,408 | B2 * | 10/2014 | DeMeo | A63B 21/4035 482/131 |
| 9,724,554 | B2 * | 8/2017 | Burkinshaw | A63B 23/1218 |
| 9,808,666 | B1 * | 11/2017 | Burkinshaw | A63B 21/068 |
| 9,914,012 | B2 * | 3/2018 | Walter | A63B 22/02 |
| 11,529,546 | B2 * | 12/2022 | Yan | A63B 22/02 |
| 2007/0161473 | A1 * | 7/2007 | McBride | A63B 21/4009 482/105 |
| 2014/0005015 | A1 * | 1/2014 | Hester | A63B 21/4043 482/131 |
| 2015/0367171 | A1 * | 12/2015 | Truong | A63B 21/0414 482/4 |
| 2017/0189758 | A1 * | 7/2017 | Angulo | A61F 5/30 |
| 2019/0232101 | A1 * | 8/2019 | Angulo | A63B 21/0555 |
| 2021/0112951 | A1 * | 4/2021 | Li | A45C 11/08 |
| 2022/0047910 | A1 * | 2/2022 | Beck | A63B 21/0442 |
| 2025/0032827 | A1 * | 1/2025 | Lee | A62B 35/0025 |

* cited by examiner

EXERCISE BELT

BACKGROUND

Exercise is a human need. Exercise gyms and exercise home equipment have a large and established market. This market includes common exercise equipment and has come to include very specific equipment that can be used to exercise specific muscles or muscle groups.

SUMMARY

An exercise belt is disclosed that can be used for various exercises such as, for example, to exercise the gluteal muscles.

For example, the exercise belt can include a belt having a first belt end, a second belt end, a belt width, and a belt length that extends from the first end to the second end; and a strap having a first strap end, a second strap end, a strap width, and a strap length extending from the first strap end to the second strap end. The strap width may be larger than the belt width, and/or the strap length may be less than the belt length. The exercise belt may include a pad having a first pad end, a second pad end, a pad width, and a pad length extending from the first pad end to the second pad end. The pad width may be substantially the same as the strap width. The pad length may be substantially the same as the strap length. The first pad end and the first strap end may be coupled together. The second pad end and the second strap end may be coupled together. The first pad end may be attached with a portion of the belt. A second pad end may by attached with a portion of the belt. A first ring may be coupled with the first end of the belt. A second ring may be coupled with the second end of the belt.

The pad may be coupled with the strap at a point other than the first strap end or the second strap end. The pad may be coupled with the belt at a point other than the first belt end or the second belt end. The belt may include nylon webbing or nylon material. The pad may include an odor resistant material. The belt length may be longer than about 44 inches. The belt width may be less than 3 inches and the strap width is less than 6 inches.

The exercise belt may include a first VELCRO portion coupled with belt at the first belt end; a second VELCRO portion coupled with the belt adjacent with the first belt end; a first VELCRO portion coupled with belt at the second belt end; a second VELCRO portion coupled with the belt adjacent with the second belt end; a first slit cut within the belt at a portion of the belt adjacent with the strap; and a second slit cut within the belt at a portion of the belt adjacent with the strap; and the first VELCRO portion and the second VELCRO portions are different VELCRO portions comprising loops or hooks.

As another example, an exercise belt may include a belt having a first belt end, a second belt end, a belt width, and a belt length that extends from the first end to the second end and a pad having a first pad end, a second pad end, a pad width, and a pad length extending from the first pad end to the second pad end. The pad length maybe less than the belt length. The first pad end may be attached with a portion of the belt. The second pad end may be attached with a portion of the belt. A first ring may be coupled with the first end of the belt and a second ring may be coupled with the second end of the belt.

The pad may be coupled with the strap at a point other than the first strap end or the second strap end. The strap width may be less than the pad width. The belt comprises nylon webbing and/or an odor resistant material. The belt length may be longer than about 44 inches.

The belt may include a strap having a first strap end, a second strap end, a strap width, and a strap length extending from the first strap end to the second strap end. The strap width may be larger than the belt width. The strap length may be less than the belt length. The pad length may be substantially the same as the strap length. The first pad end and the first strap end may be coupled together. The second pad end and the second strap end may be coupled together.

The pad may be coupled with the belt at a point other than the first belt end or the second belt end.

The strap width may be less than 6 inches.

The exercise belt may also include a first VELCRO portion coupled with belt at the first belt end; a second VELCRO portion coupled with the belt adjacent with the first belt end; a first VELCRO portion coupled with belt at the second belt end; a second VELCRO portion coupled with the belt adjacent with the second belt end; a first slit cut within the belt at a portion of the belt adjacent with the strap; and a second slit cut within the belt at a portion of the belt adjacent with the strap. The first VELCRO portion and the second VELCRO portions may be different VELCRO portions comprising either loops or hooks.

DETAILED DESCRIPTION

An exercise belt is disclosed. The exercise belt, for example, may include an elongated belt stitched with a shorter padded portion and having rings on both ends of the belt. The exercise belt may also include a strap disposed between the belt and the padded portion that may, for example, provide additional structural support. The exercise belt may include VELCRO on portions of the belt and slit through portions of the belt that allow a user to shorten the length of the belt when in use.

In use, the padded portion may be worn across the front waist of a person such that the ends of the belt and the rings are located behind the person. These rings, for example, may be coupled with various exercise equipment to perform various exercises such as, for example, to exercise one or all of the gluteal muscles.

Figure 1:
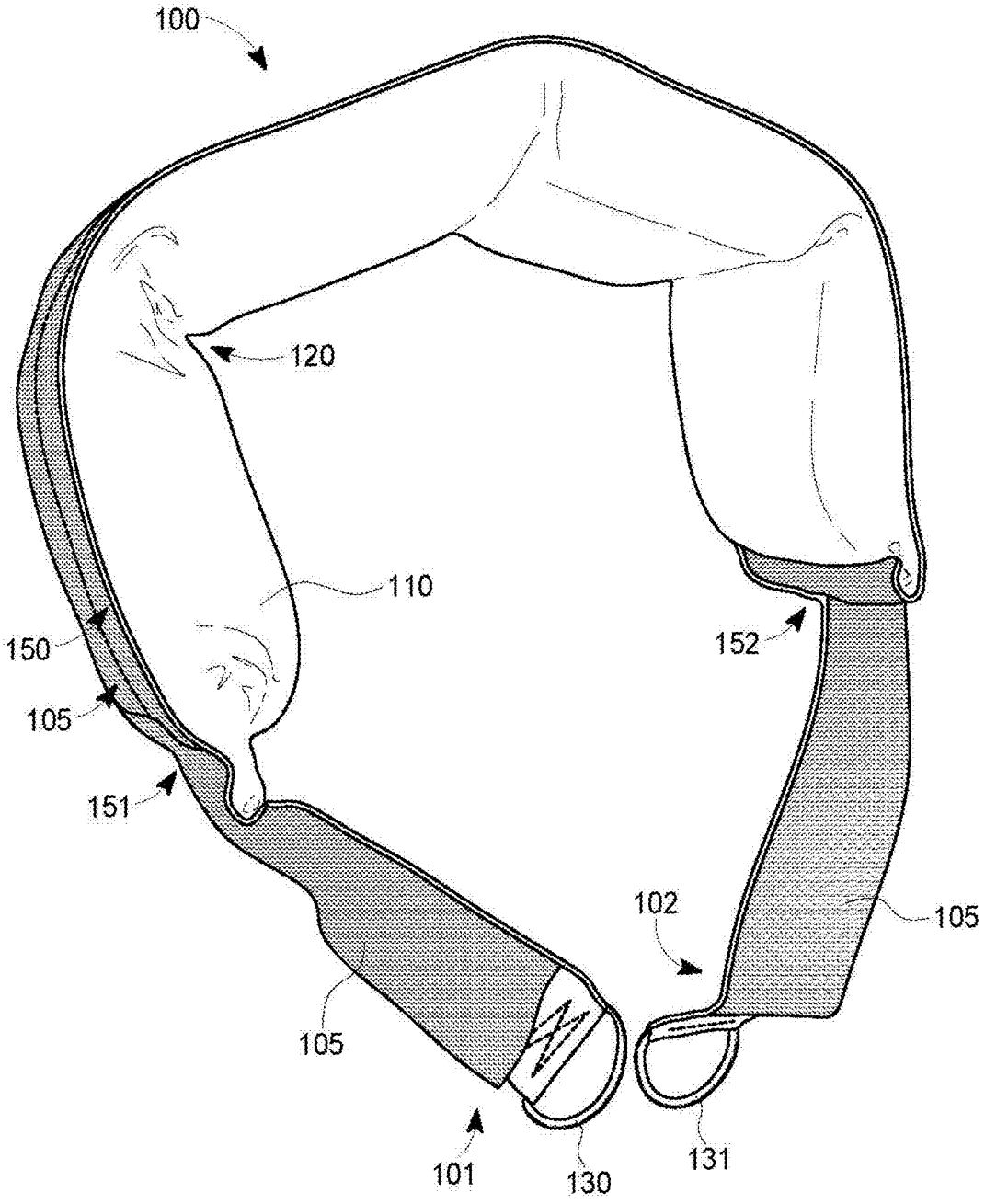
FIG. 1 is a top side view of an example exercise belt.

FIG. 1 is a top side view of an exercise belt 100. The exercise belt 100 may include a belt 105 that may have a first belt end 101 and a second belt end 102. The belt 105 has a belt width, which may, for example, example be less than about 4, 3, or 2 inches. The belt 105 has a belt length, which may, for example, example be less than about 60, 55, 45, 40, etc. inches. The belt length may extend from the first belt end 101 to the second belt end 102.

The first belt end 101 may be coupled with a first belt ring 130. The second belt end 102 may be coupled with a second belt ring 131. The first belt ring 130 and/or the second belt ring 131, for example, may be a metallic rings or a metallic D ring. The first belt end 101 may be folded over a portion of the first belt ring 130 and stitched with a portion of the belt 105 near the first belt end 101. The second belt end 102 may be folded over a portion of the second belt ring 131 and stitched with a portion of the belt 105 near the second belt end 102. The first belt ring 130 and the second belt ring 131 may comprise the same type or shape of ring.

The first belt ring 130 and/or the second belt ring 131, for example, may include a D ring having an arced portion and a straight portion. The flat portion, for example, may be coupled with the belt 105. For example, the first belt end 101 may be folded over the straight portion of the first belt ring 130 and stitched with a portion of the belt 105 near the first belt end 101; and/or the second belt end 102 may be folded over the straight portion of the second belt ring 131 and stitched with a portion of the belt 105 near the second belt end 102.

The belt 105, for example, may comprise a nylon material such as, for example, nylon webbing.

The exercise belt 100 may include a strap 150 having a first strap end 151 and a second strap end 152. The strap 150 may have a strap width that may, for example, be less than about 8, 6, 5, 4, 3, etc. inches. The strap 150 may have a strap length that extends from the first strap end 151 to the second strap end 152. The strap length, for example, may be less than about 30, 24, 28, 26, 24, etc. inches.

The strap width, for example, may be larger than the belt width. The strap length, for example, may be less than the belt length.

The strap 150, for example, may comprise a nylon material such as, for example, nylon webbing, polypropylene webbing, polypropylen webbing, hemp webbing, cotton webbing, polyester webbing, linen webbing, or similar webbings.

The exercise belt 100 may include a pad 110 or a plurality of pads. The pad 110 may have a first pad end and a second pad end. The first pad end may be coupled with the first strap end 151 such as, for example, with stitching. The second pad end may be coupled with the second strap end 152 such as, for example, with stitching. The pad 110 may have a pad width that may, for example, be less than about 10, 8, 6, etc. inches. The pad 110 may have a pad length that may for example, may be less than about 30, 24, 28, etc. inches.

The pad width, for example, may be substantially the same as the strap width. The pad length, for example, may be substantially the same as the strap length.

The pad 110, for example, may comprise a polyester, spandex, polypropylene, nylon, polyester, sorona, elastane lycra, cotton, etc. material (or a combination thereof) surrounding a padding material. The pad 110, for example, may comprise an odor resistant material.

The pad 110, may be filled with a padding material that includes foam or other padding or filler.

The first pad end may be coupled with the first strap end 151 such as, for example, with stitching. The first pad end and the first strap end 151 may be coupled with the belt 105 such as, for example, with stitching. The second pad end may be coupled with the second strap end 152 such as, for example, with stitching. The second pad end and the second strap end 152 may be coupled with the belt 105 such as, for example, with stitching.

The first strap end 151 may be folded over the first pad end and stitched to the first pad end and a portion of the strap 150 near the first strap end 151. The second strap end 152 may be folded over the second pad end and stitched to the second pad end and a portion of the strap 150 near the second strap end 152.

The belt 105, for example, may be stitched with the strap 150 along a length of the strap 150. The belt 105, for example, may be stitched with the strap 150 along both sides of the belt 105 along a length of the strap 150

The belt 105, the strap 150, and/or the pad 110 may be stitched together at a plurality of points along the pad 110 and/or the strap 150. This may, for example, allow for a plurality of portions of the pad to be stitched and compressed, a plurality of other portions that remain full and padded.

The strap 150 may be stitched with the 110 at a plurality of portions of the pad 110 and the strap 150.

Figure 2:
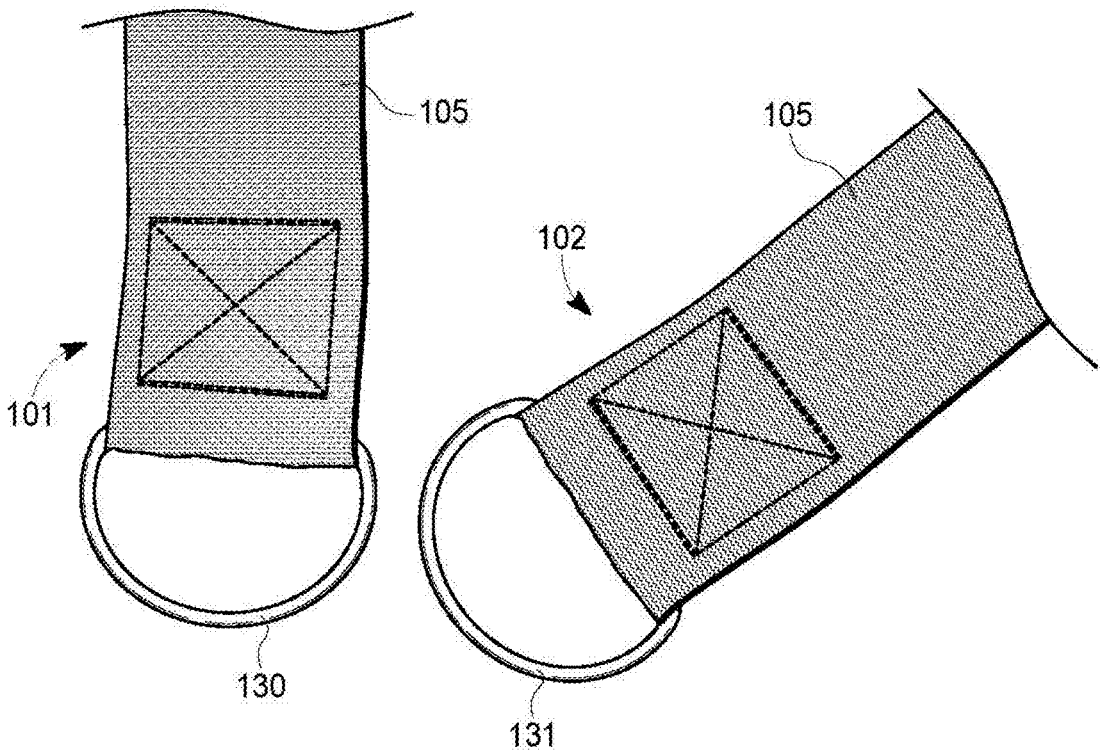
FIG. 2 shows the two ends of the exercise belt shown in FIG. 1.

FIG. 2 shows the first belt end 101 coupled with the first belt ring 130 and the second belt end 102 coupled with the second belt ring 131.

Figure 3:
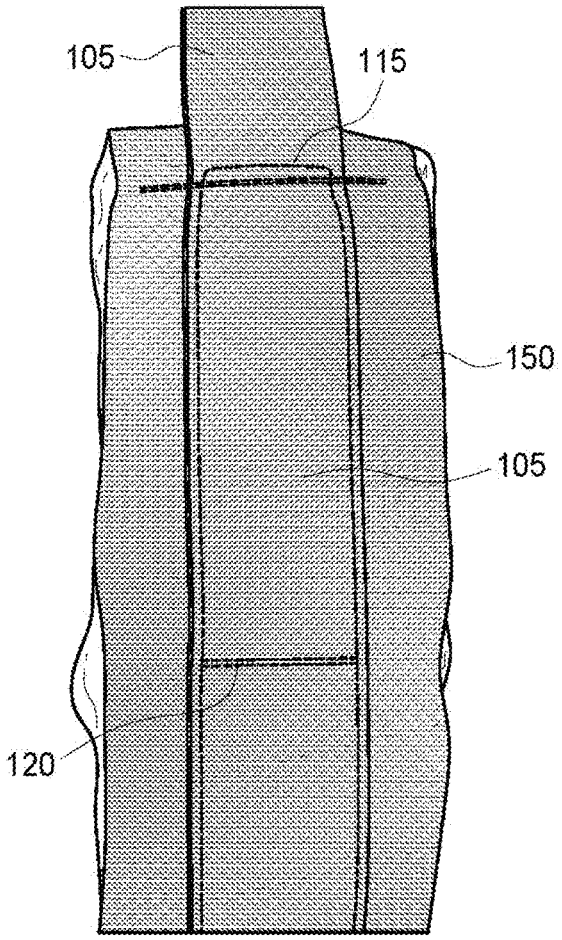
FIG. 3 is a portion of a back side view of the exercise belt shown in FIG. 1.

FIG. 3 shows a portion of a back side view of an exercise belt 100. The belt 105 and/or the strap 150, for example, may be stitched with the pad 110 with a stitch 120 that extends along a width of the belt 105. The belt 105 and/or an end of the strap 150 (e.g., first strap end 151 or second strap end 152), for example, may be stitched with the pad 110 with a stitch 115 that extends along a width of the belt 105 or along a width of the strap 150.

The strap 105, for example, may be coupled with the strap 150 via stitching running the length of the strap 150 on either or both sides of the strap 105. As another example, the strap 105 may be coupled with the strap 150 at a number of attachment points (e.g., 3, 4, 5, 6 etc.) with stitching running the width of the strap 105 at each of the attachment points. As another example, the strap 105 may be coupled with the strap 150 both 1) at a number of attachment points (e.g., 3, 4, 5, 6 etc.) with stitching running the width of the strap 105 at each of the attachment points and 2) via stitching running the length of the strap 150 on either or both sides of the strap 105.

Figure 4:
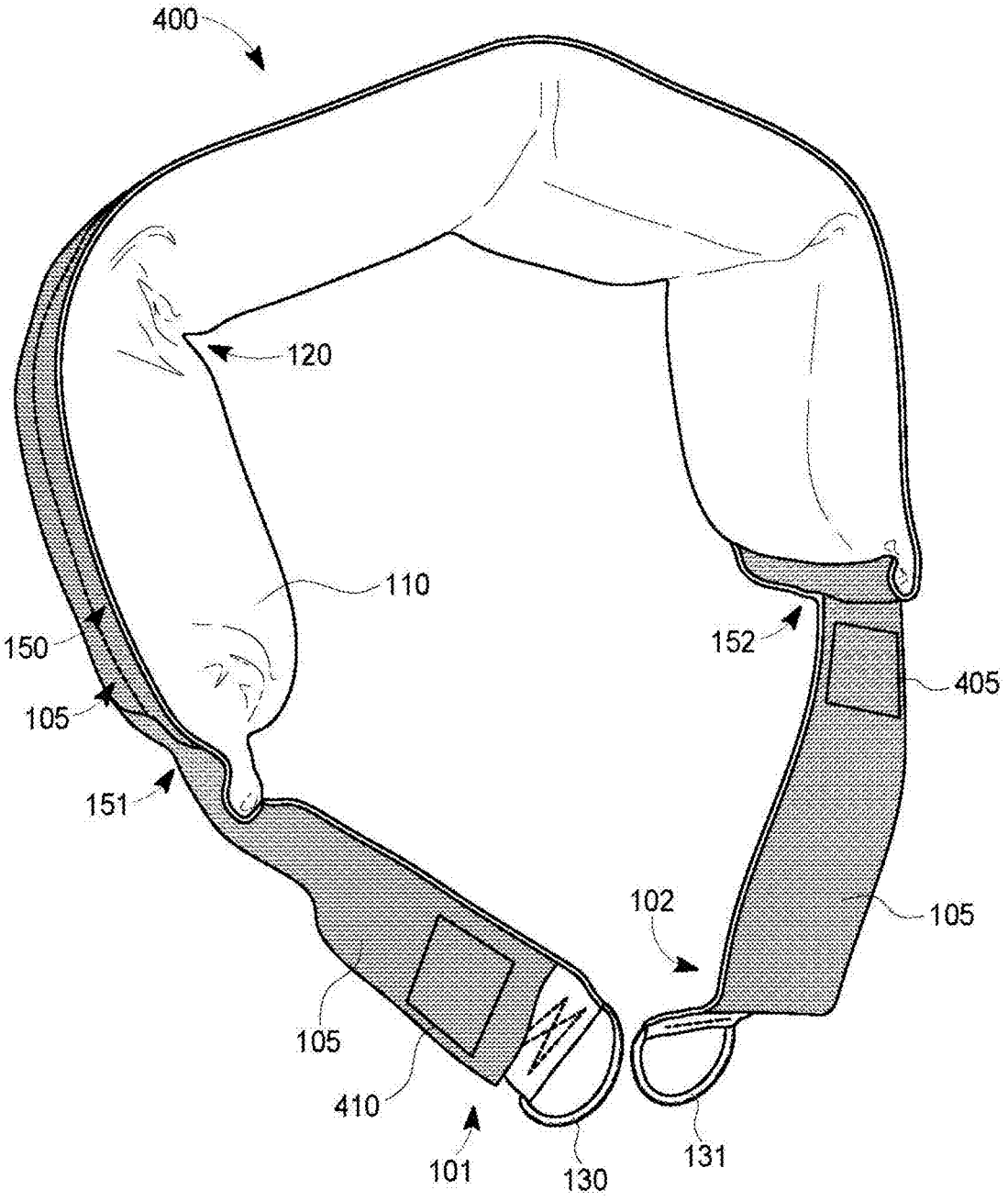
FIG. 4 is a top side view of another example exercise belt.

FIG. 4 is a top side view of another example exercise belt 400. In this example, the exercise belt 100 is modified to form exercise belt 400 in a way that may allow the belt to be shortened. In this example, the belt 105 may include VELCRO on the portions of the belt 105 that is not coupled with or attached with pad 110. A first VELCRO portion 410 may be attached to the belt 105 adjacent with the first belt end 101 on a first side of the belt 105. Another first VELCRO portion 410 may also be attached to the belt 105 adjacent with the second belt end 102 on the first side of the belt 105. The first side of the belt 105 is the portion of the belt 105 facing away from the pad 110. A second VELCRO portion 405 may be attached to the belt 105 adjacent with the first strap end 151 on a second side of the belt 105. Another second VELCRO portion 405 may also be attached to the belt adjacent with the second strap end 152 on the second side of the belt 105. The second side of the belt 105 is the portion of the belt 105 facing toward the pad 110.

In one example, the first VELCRO portion 410 may include fabric with hooks and the second VELCRO portion 405 may include fabric with loops. As another example, the second VELCRO portion 405 may include fabric with hooks and the first VELCRO portion 410 may include fabric with loops.

Figure 5:
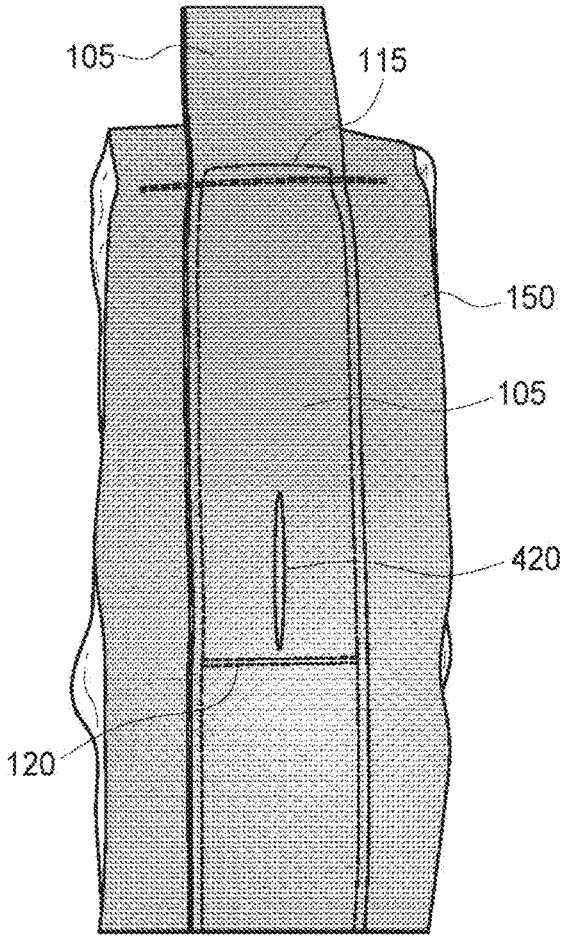
FIG. 5 is a portion of a back side view of the exercise belt shown in FIG. 4.

FIG. 5 is a portion of a back side view of the exercise belt shown in FIG. 4. The belt 105, for example, may include two slits cut within two different portions of the belt 105. A first slit 420 may be in a portion of the belt 105 adjacent to the pad 100 on one end of the belt and a second slit (similar to the first slit) may be in a portion of the belt 105 adjacent to the pad 110 on the other end of the belt. The belt 105 may include stitching on or around all or a portion of either slit to reinforce the slit. The slits may have a length that is larger than the width of the belt 105 such as, for example, 5%, 10%, 15%, 20% larger than the width of the belt 105.

The length of the strap 105 that extends from the first strap end 151 to the first belt end 101 may be twice the length as the distance from the slit to the first strap end 151 and/or the length of the strap 105 that extends from the second strap end 152 to the second belt end 102 may be twice the length as the distance from the slit to the second strap end 152.

To shorten the length of the exercise belt 400, the first belt end 101 may be routed through a first slit and the second VELCRO portion 405 may be coupled with the first VELCRO portion 410 and the second belt end 102 may be routed through a second slit and the second VELCRO portion 405 may be coupled with the first VELCRO portion 410.

Unless otherwise specified, the term "substantially" means within 5% or 10% of the value referred to or within manufacturing tolerances. Unless otherwise specified, the term "about" means within 5% or 10% of the value referred to or within manufacturing tolerances.

The conjunction "or" is inclusive.

The terms "first", "second", "third", etc. are used to distinguish respective elements and are not used to denote a particular order of those elements unless otherwise specified or order is explicitly described or required.

Numerous specific details are set forth to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed:

1. An exercise belt comprising:

a belt having a first belt end, a second belt end, a belt width, and a belt length that extends from the first belt end to the second belt end;

a strap having a first strap end, a second strap end, a strap width, and a strap length extending from the first strap end to the second strap end, wherein:

the strap width is larger than the belt width, and the strap length is less than the belt length;

a pad having a first pad end, a second pad end, a pad width, and a pad length extending from the first pad end to the second pad end, wherein:

the pad width is substantially the same as the strap width, the pad length is substantially the same as the strap length, the first pad end and the first strap end are coupled together, the second pad end and the second strap end are coupled together, the first pad end is attached with a first portion of the belt, and the second pad end is attached with a second portion of the belt;

a first ring coupled with the first belt end of the belt;

a second ring coupled with the second belt end of the belt;

a first belt end first hook and loop portion coupled with the belt at the first belt end;

a first belt end second hook and loop portion coupled with the belt adjacent with the first belt end;

a second belt end first hook and loop portion coupled with the belt at the second belt end;

a second belt end second hook and loop portion coupled with the belt adjacent with the second belt end;

a first slit cut within the belt at a third portion of the belt adjacent with the strap; and a second slit cut within the belt at a fourth portion of the belt adjacent with the strap;

wherein the first hook and loop portions and the second hook and loop portions are respectively different portions comprising loops or hooks; and wherein the belt length is configured to be shortened by respectively routing the first and second belt ends through the first and second slit cuts within the belt, and then respectively coupling the first belt end first and second hook and loop portions and the second belt end first and second hook and loop portions.

2. The exercise belt according to claim 1, wherein the pad is coupled with the strap at a point other than the first strap end or the second strap end.

3. The exercise belt according to claim 1, wherein the pad is coupled with the belt at a point other than the first belt end or the second belt end.

4. The exercise belt according to claim 1, wherein the belt comprises nylon webbing.

5. The exercise belt according to claim 1, wherein the pad comprises a nylon material.

6. The exercise belt according to claim 1, wherein the pad comprises an odor resistant material.

7. The exercise belt according to claim 1, wherein the belt length is longer than about 44 inches.

8. The exercise belt according to claim 1, wherein the belt width is less than 3 inches and the strap width is less than 6 inches.

9. An exercise belt comprising:

a belt having a first belt end, a second belt end, a belt width, and a belt length that extends from the first belt end to the second belt end;

a pad having a first pad end, a second pad end, a pad width, and a pad length extending from the first pad end to the second pad end, wherein:

the pad length is less than the belt length, the first pad end is attached with a first portion of the belt, and the second pad end is attached with a second portion of the belt;

a first ring coupled with the first belt end of the belt;

a second ring coupled with the second belt end of the belt;

a first belt end first hook and loop portion coupled with the belt at the first belt end;

a first belt end second hook and loop portion coupled with the belt adjacent with the first belt end;

a second belt end first hook and loop portion coupled with the belt at the second belt end;

a second belt end second hook and loop portion coupled with the belt adjacent with the second belt end;

a first slit cut within the belt at a third portion of the belt adjacent with the strap; and a second slit cut within the belt at a fourth portion of the belt adjacent with the strap;

wherein the first hook and loop portions and the second hook and loop portions are respectively different portions comprising loops or hooks; and wherein the belt length is configured to be shortened by respectively routing the first and second belt ends through the first and second slit cuts within the belt, and then respectively coupling the first belt end first and second hook and loop portions and the second belt end first and second hook and loop portions.

10. The exercise belt according to claim 9, wherein the belt comprises nylon webbing.

11. The exercise belt according to claim 9, wherein the pad comprises an odor resistant material.

12. The exercise belt according to claim 9, wherein the belt length is longer than about 44 inches.

13. The exercise belt according to claim 9, further comprising a strap having a first strap end, a second strap end, a strap width, and a strap length extending from the first strap end to the second strap end, wherein:

the strap width is larger than the belt width, and the strap length is less than the belt length.

14. The exercise belt according to claim 13, wherein the pad is coupled with the strap at a point other than the first strap end or the second strap end.

15. The exercise belt according to claim 13, wherein the strap width is less than the pad width.

16. The exercise belt according to claim 13, wherein:

the pad length is substantially the same as the strap length;

the first pad end and the first strap end are coupled together; and the second pad end and the second strap end are coupled together.

17. The exercise belt according to claim 13, wherein the pad is coupled with the belt at a point other than the first belt end or the second belt end.

18. The exercise belt according to claim 13, wherein the strap width is less than 6 inches.

* * * * *